US010987958B2

(12) United States Patent
Kubota

(10) Patent No.: US 10,987,958 B2
(45) Date of Patent: Apr. 27, 2021

(54) PRINTER COVER

(71) Applicant: SEIKO EPSON CORPORATION, Tokyo (JP)

(72) Inventor: Tomoyuki Kubota, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 151 days.

(21) Appl. No.: 15/922,271

(22) Filed: Mar. 15, 2018

(65) Prior Publication Data

US 2018/0272773 A1 Sep. 27, 2018

(30) Foreign Application Priority Data

Mar. 22, 2017 (JP) ..... JP2017-055810

(51) Int. Cl.

*B41J 29/13* (2006.01)
*B41J 15/04* (2006.01)
*B41J 29/02* (2006.01)
*B41J 3/407* (2006.01)

(52) U.S. Cl.

CPC ..... *B41J 29/13* (2013.01); *B41J 3/4075* (2013.01); *B41J 15/044* (2013.01); *B41J 29/02* (2013.01)

(58) Field of Classification Search

CPC ..... B41J 3/4075; B41J 15/044; B41J 29/02; B41J 29/13

See application file for complete search history.

(56) References Cited

U.S. PATENT DOCUMENTS 8,965,458 B2 * 2/2015 Richardson ..... A45C 11/00 455/566
9,642,426 B2 5/2017 Tien
2005/0056444 A1 * 3/2005 Murata ..... B41J 3/4075 174/50
2007/0139505 A1 * 6/2007 Kaiya ..... B41J 29/13 347/108
2007/0147938 A1 * 6/2007 Brown ..... B41J 3/44 400/613
2009/0034169 A1 * 2/2009 Richardson ..... G06F 1/1626 361/679.01
2009/0206548 A1 * 8/2009 Hawkins ..... A63F 9/04 273/146

(Continued)

FOREIGN PATENT DOCUMENTS

CN 101973168 * 2/2011 ..... B41J 29/12
CN 204774134 U 11/2015

(Continued)

*Primary Examiner* — Matthew G Marini
*Assistant Examiner* — Marissa Ferguson-Samreth
(74) *Attorney, Agent, or Firm* — Oliff PLC

(57) ABSTRACT

A printer cover is mounted on a tape printer that includes a plurality of housing faces that include a first housing face in which a first cavity opening portion of a cartridge mounting section into which a tape cartridge is mounted is formed and a lid member that openably closes the first cavity opening portion. The printer cover is an integrally formed body having elasticity. The printer cover has cover faces that include the first cover face that covers the first mounting-side housing face, and a first lid-exposure opening that is provided in the first mounting-side cover face and through which lid member is exposed.

9 Claims, 11 Drawing Sheets

(56) References Cited

U.S. PATENT DOCUMENTS

| | | | | |
|---|---|---|---|---|
| 2010/0104814 | A1* | 4/2010 | Richardson | A45C 11/00 428/156 |
| 2010/0119284 | A1* | 5/2010 | Vandermeulen | B41J 3/4075 400/621 |
| 2010/0203931 | A1* | 8/2010 | Hynecek | A45C 11/00 455/575.8 |
| 2015/0115037 | A1* | 4/2015 | Hoobler | H04B 1/3888 235/462.45 |
| 2015/0349831 | A1* | 12/2015 | Young | H04B 1/3888 455/575.8 |
| 2016/0021996 | A1 | 1/2016 | Tien | |
| 2017/0028756 | A1* | 2/2017 | Koshigoe | B41J 3/36 |

FOREIGN PATENT DOCUMENTS

| | | | | |
|---|---|---|---|---|
| CN | 205987027 | U | 2/2017 | |
| JP | H11-240225 | A | 9/1999 | |
| JP | H11-254789 | A | 9/1999 | |
| JP | 2006-295089 | A | 10/2006 | |
| JP | 2009-131978 | A | 6/2009 | |
| JP | 2014-188704 | * | 10/2014 | B41J 29/08 |
| JP | 3194569 | U | 11/2014 | |

* cited by examiner

PRINTER COVER

BACKGROUND

1. Technical Field

The present invention relates to a printer cover that is mounted on a tape printer.

2. Related Art

As disclosed by JP-A-11-254789, a printer cover (shock absorption member) that is mounted on a printer (portable printer) having an openable/closable lid (open cover) is known. This printer cover is mounted on a printer such that the printer cover covers a pivot edge of a lid. Note that terms in parentheses in this paragraph are the terms used in JP-A-11-254789.

A known printer cover covers the pivot edge of a lid when the printer cover is mounted on a printer and thereby hinders opening/closing of the lid. Thus, to open the lid, it is necessary to remove the printer cover, which is inconvenient.

SUMMARY

An advantage of some aspects of the invention is that a printer cover that enables opening/closing of a cartridge lid while the printer cover is mounted on a tape printer is provided.

A printer cover according to an aspect of the invention is an integrally formed body having elasticity and is mounted on a tape printer that includes a plurality of housing faces that include mounting-side housing faces in which corresponding cavity opening portions of a cartridge mounting section into which a tape cartridge is mounted are formed, and a cartridge lid that openably closes the cavity opening portions. In addition, the printer cover includes a plurality of cover faces including mounting-side cover faces that cover the corresponding mounting-side housing faces, and a plurality of lid exposure openings that are provided in the corresponding mounting-side cover faces and through which the cartridge lid is exposed.

With this configuration, the cartridge lid is exposed through the lid exposure opening while the printer cover is mounted on the tape printer. This enables the cartridge lid to be opened/closed while the printer cover is mounted on the tape printer.

In this case, it is preferable that in the tape printer, the cartridge lid include a first lid portion and a second lid portion that continues to the first lid portion, that the first lid portion closes a first cavity opening portion of the cavity opening portions that is formed in a first mounting-side housing face of the mounting-side housing faces, and that the second lid portion be formed in a second mounting-side housing face of the mounting-side housing faces that continues to the first mounting-side housing face and closes a second cavity opening portion of the cavity opening portions that continues to the first cavity opening portion. In addition, it is preferable that in the printer cover, the mounting-side cover faces include a first mounting-side cover face that covers the first mounting-side housing face and a second mounting-side cover face that continues to the first mounting-side cover face and covers the second mounting-side housing face, and the lid-exposure openings include a first lid-exposure opening that is provided in the first mounting-side cover face and through which the first lid portion is exposed and a second lid-exposure opening that is provided in the second lid portion and continues to the first lid-exposure opening and through which the second lid portion is exposed.

With this configuration, the first lid portion of the cartridge lid is exposed through the first lid-exposure opening, and the second lid portion of the cartridge lid is exposed through the second lid-exposure opening. This enables the cartridge lid to be opened/closed while the printer cover is mounted on the tape printer. In addition, the first lid-exposure opening and the second lid-exposure opening are continuously formed, which allows a user to expand the first lid-exposure opening and the second lid-exposure opening easily.

In this case, it is preferable that the printer cover further include a cover-side chamfered portion. In addition, the tape printer further includes a printer-side chamfered portion provided at a corner portion of the tape printer at which two of the housing faces that intersect the mounting-side housing face intersect each other. Moreover, the cover-side chamfered portion is provided at a corner portion of the printer cover at which two of the cover faces that intersect the mounting-side cover face intersect each other, and the cover-side chamfered portion covers the printer-side chamfered portion.

With this configuration, when the printer cover is mounted onto the tape printer, the corner portion of the printer cover at which the two cover faces intersect each other can easily fit into the corner portion of the tape printer at which the two housing faces intersect each other.

In this case, it is preferable that in the tape printer, the printer-side chamfered portion extend toward the mounting-side housing face and incline toward the mounting-side housing face interior and that in the printer cover, the cover-side chamfered portion extend toward the mounting-side cover face and incline toward the mounting-side cover face interior.

With this configuration, a user can pull the end of the cover-side chamfered portion near the mounting-side cover face outward from the mounting-side cover face with less effort compared with a case in which the cover-side chamfered portion does not incline. Consequently, the lid exposure openings can be expanded easily.

In this case, it is preferable that the printer cover further include a button cover and the tape printer have an operation button and that the button cover cover the operation button and have a thickness different from that of a peripheral portion of the button cover.

With this configuration, the position of the operation button is made recognizable, and the operability of the power button can be improved in the state in which the printer cover is mounted on the tape printer.

In this case, it is preferable that in the mounting-side cover face, a peripheral portion surrounding the lid exposure opening have an edge width of 10 mm or more and 15 mm or less.

With this configuration, the peripheral portion surrounding the lid exposure opening has an edge width of 10 mm or more so that the edge portion of the tape printer can be protected appropriately. In addition, the peripheral portion surrounding the lid exposure opening has an edge width of 15 mm or less so that the printer cover can be easily mounted/unmounted.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
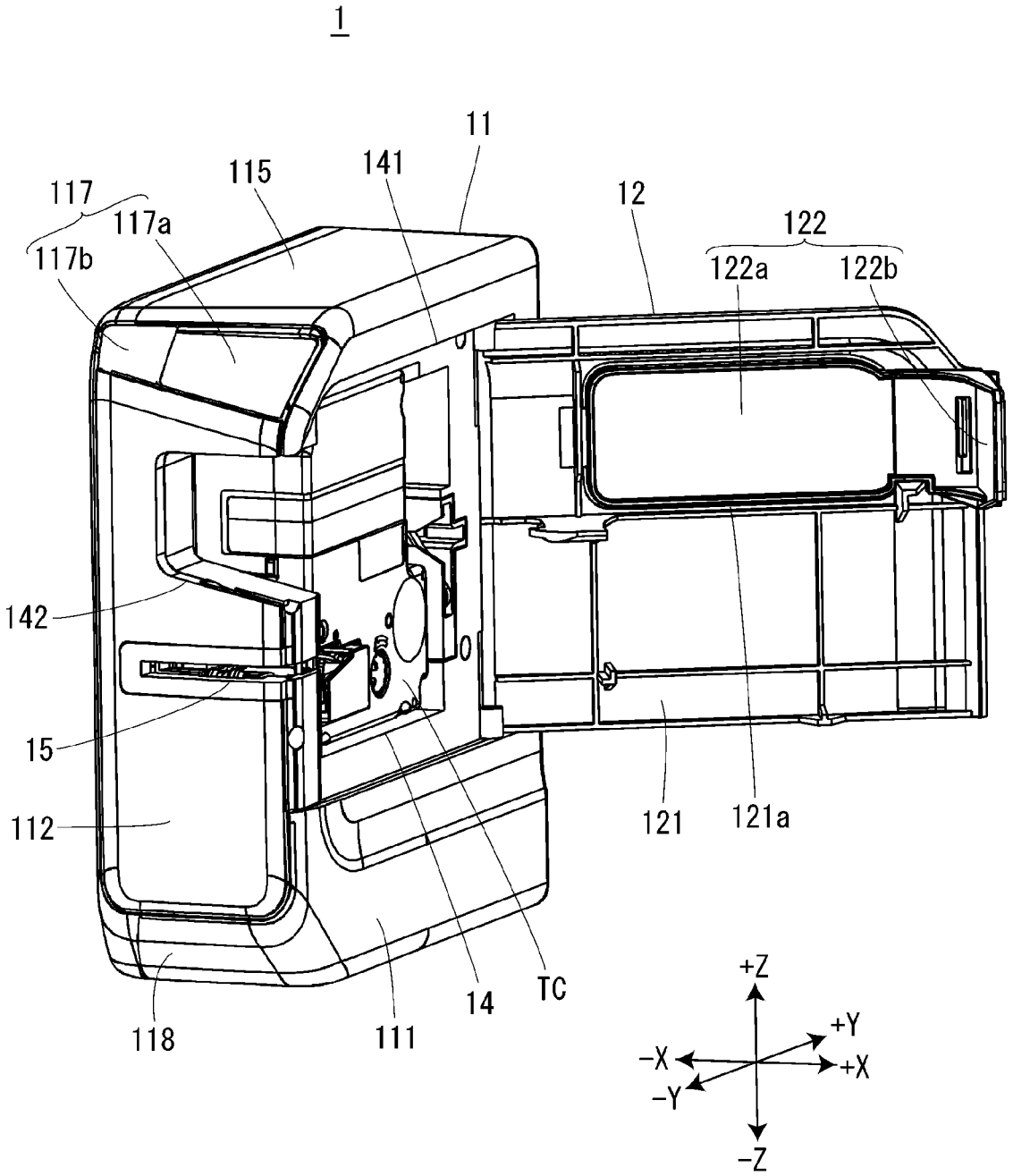
FIG. 1 is a perspective view illustrating a tape printer on which a printer cover according to one embodiment of the invention is to be mounted, and the tape printer is in a state in which a cartridge lid is open.
Figure 2:
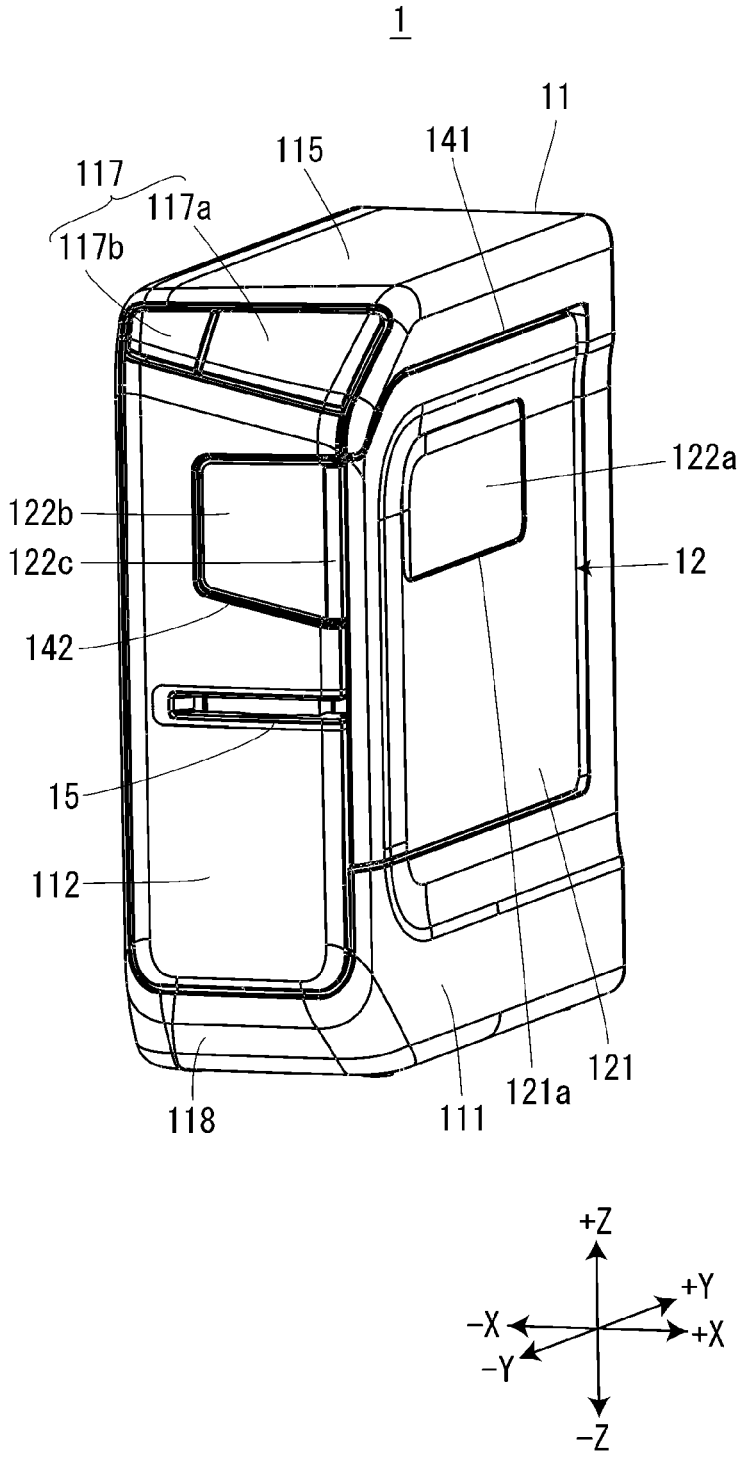
FIG. 2 is a perspective view illustrating the tape printer when the cartridge lid is closed.
Figure 3:
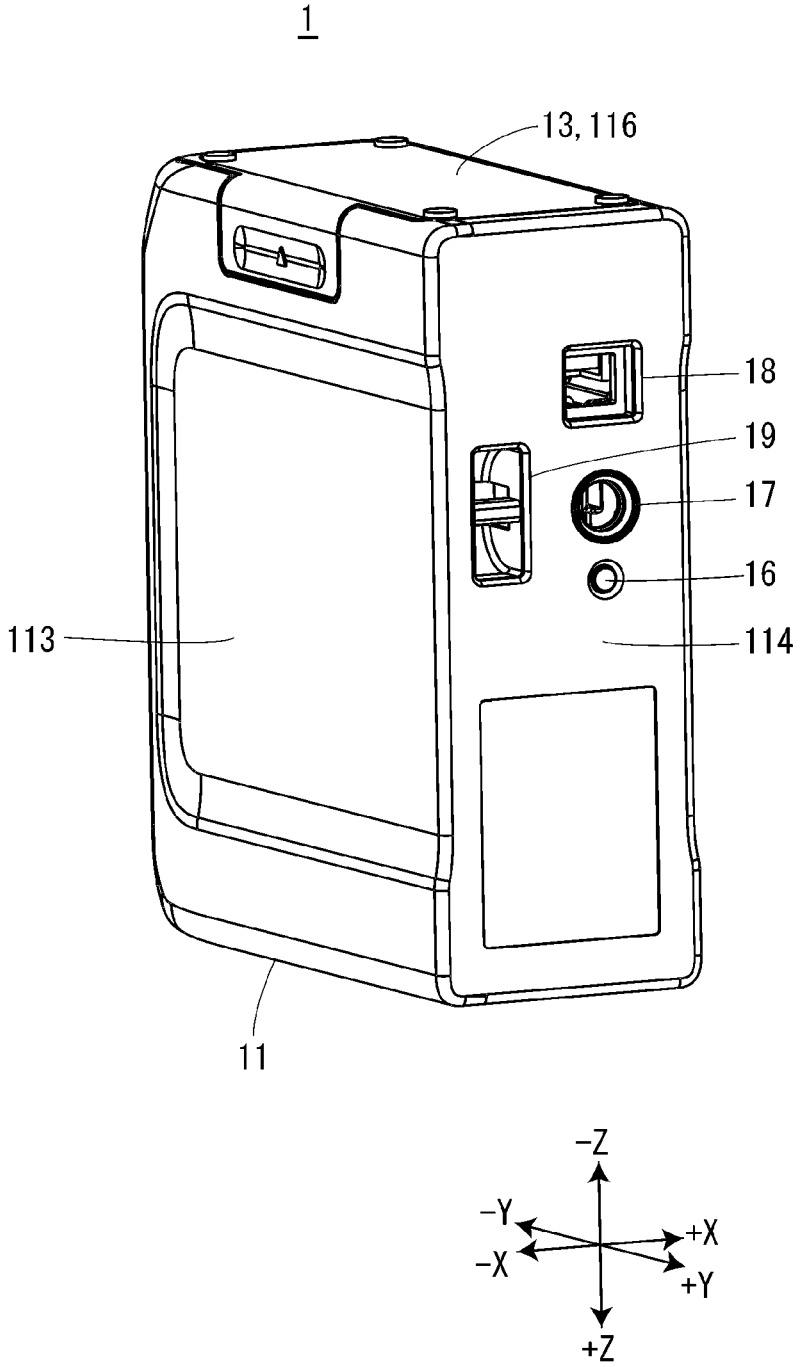
FIG. 3 is a perspective view illustrating the tape printer when viewed in a direction different from that of FIG. 2.
Figure 4:
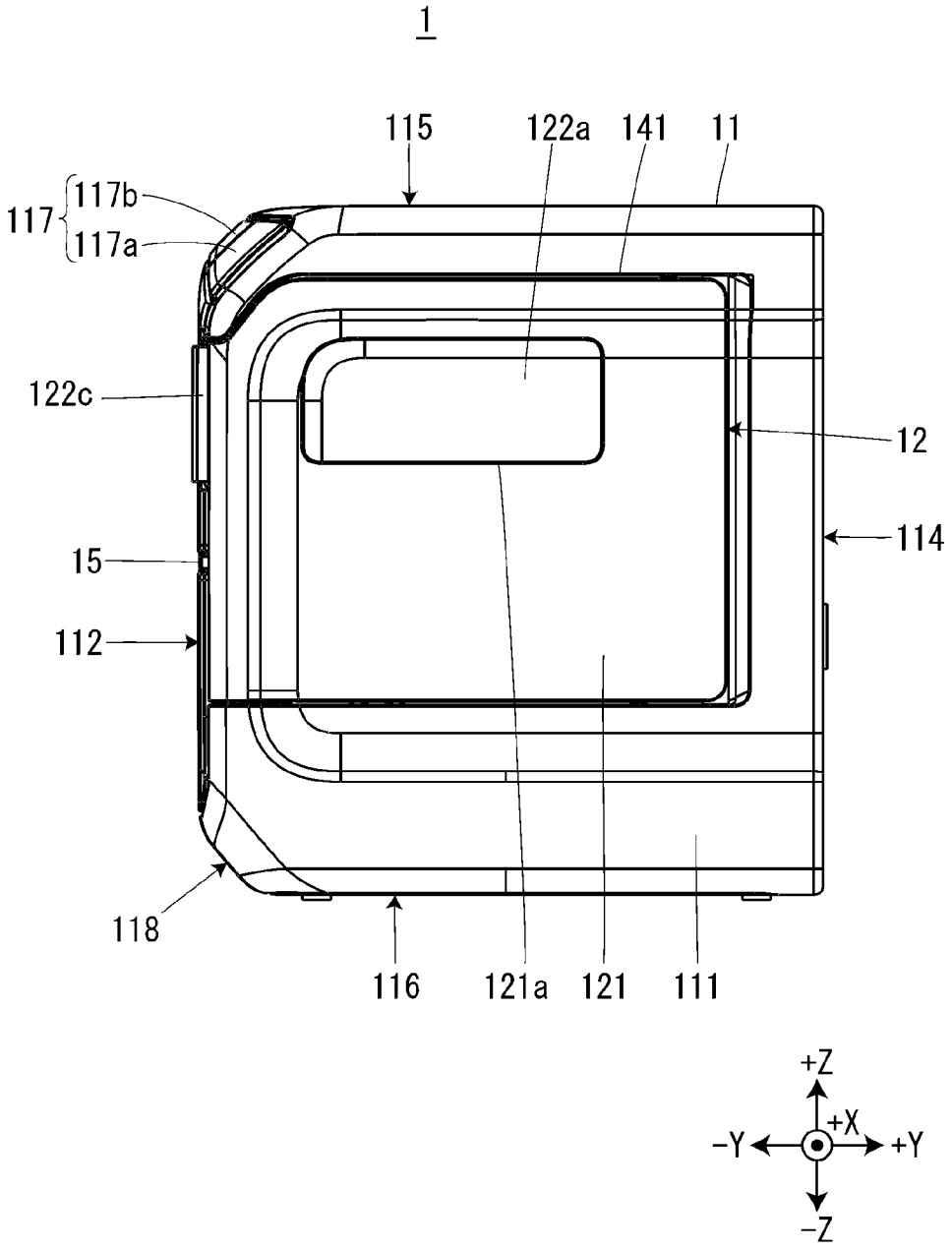
FIG. 4 is a view illustrating the tape printer when viewing a first housing face.
Figure 5:
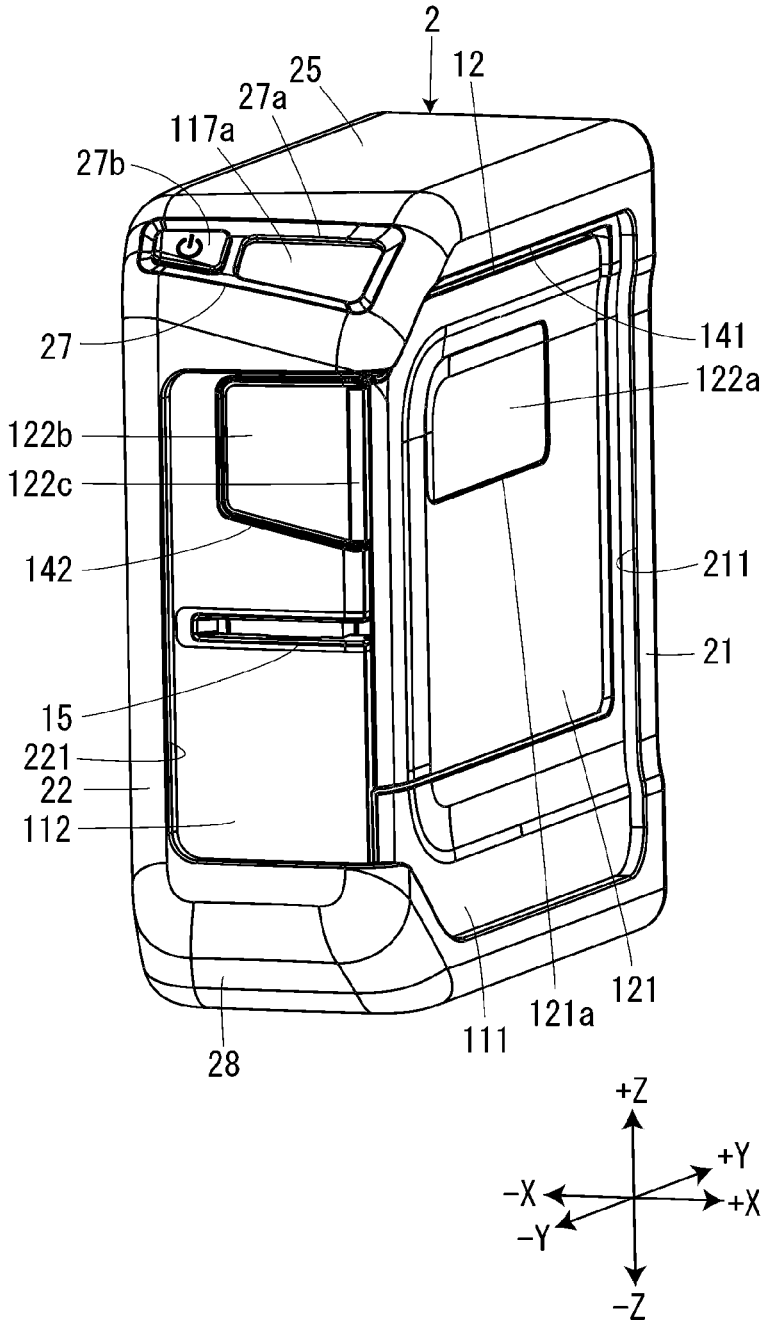
FIG. 5 is a perspective view illustrating a printer cover that is mounted on the tape printer.
Figure 6:
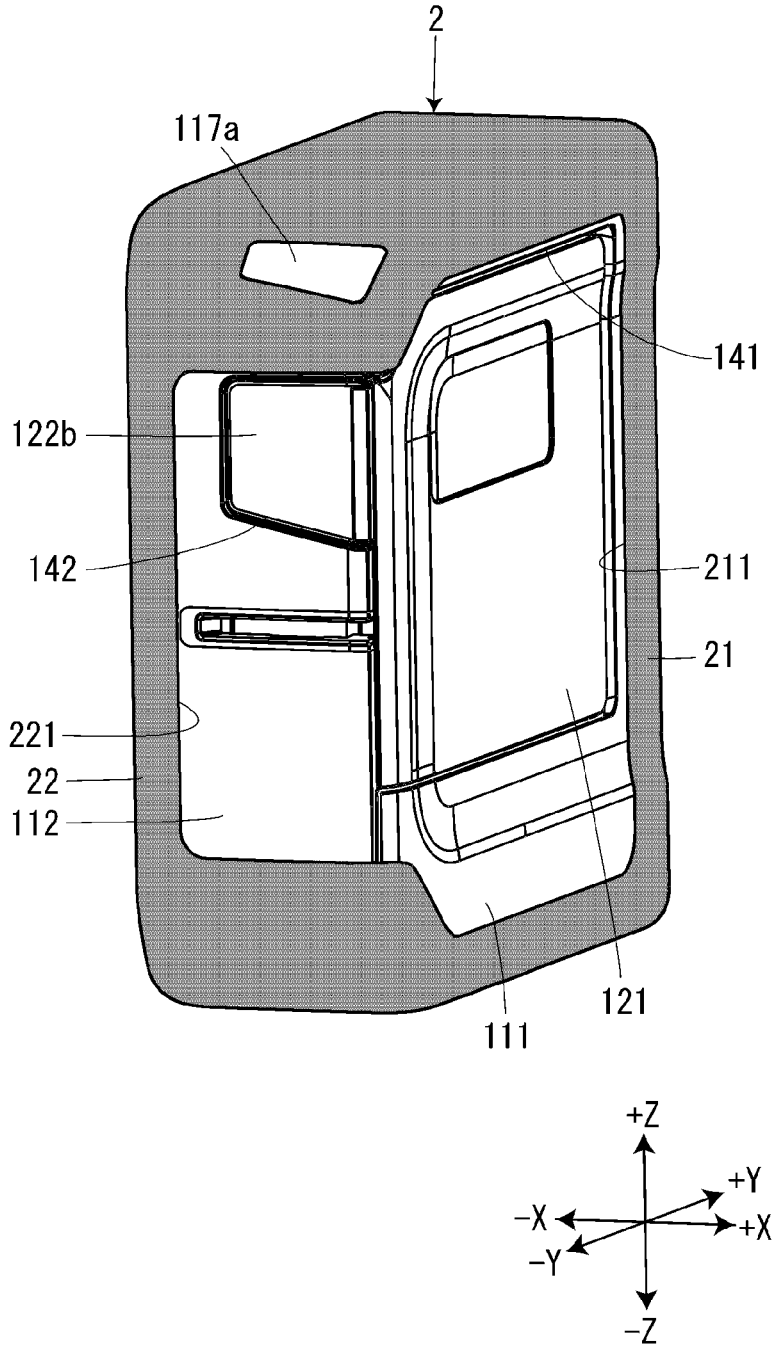
FIG. 6 is a view in which the printer cover of FIG. 5 is filled with solid black.
Figure 7:
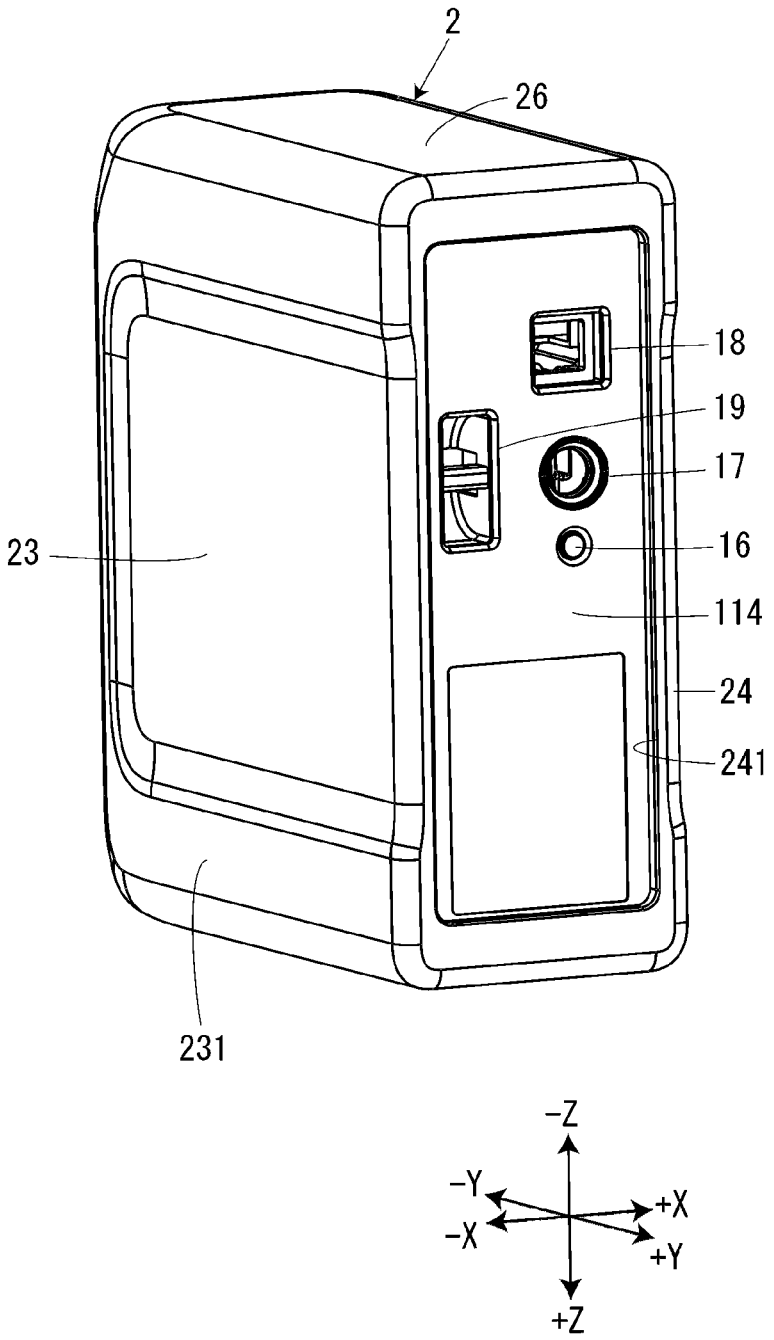
FIG. 7 is a perspective view illustrating a printer cover that is mounted on the tape printer when viewed in a direction different from that of FIG. 5.
Figure 8:
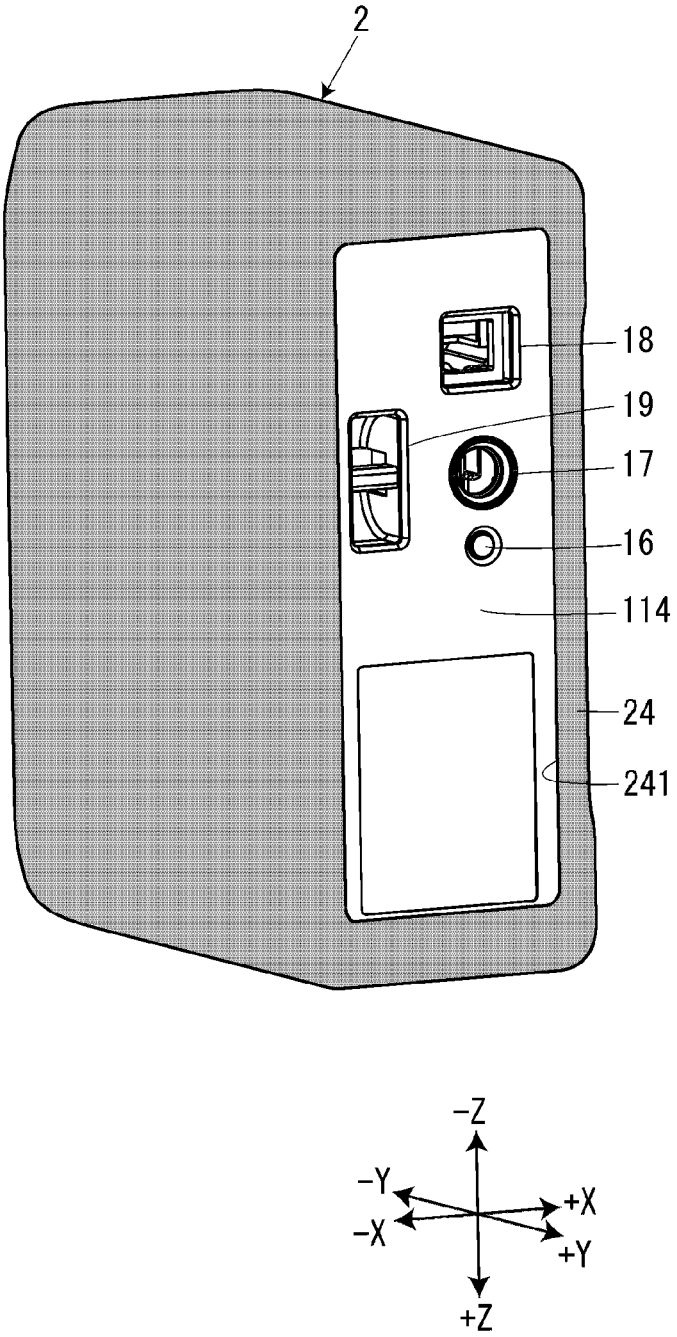
FIG. 8 is a view in which the printer cover of FIG. 7 is filled with solid black.

One embodiment of a printer cover according to the invention is described below. The printer cover according to the present embodiment is to be mounted on a tape printer to protect the tape printer from being damaged by external causes, such as drop impact. Note that the XYZ orthogonal coordinate system is shown in the drawings, when necessary, so as to facilitate a clear understanding of component arrangement. It should be understood, however, that this does not limit the invention in any way.

A tape printer 1 will be described with reference to FIGS. 1 to 4. The tape printer 1 includes a cartridge mounting section 14 and a printing mechanism (not shown). In accordance with print data sent from an external device, such as a computer or a smartphone, the printing mechanism performs printing onto a tape strip (not shown) supplied from a tape cartridge TC that is mounted in the cartridge mounting section 14. The tape printer 1 includes an apparatus housing 11, a cartridge lid 12, and a battery lid 13, which constitute the outer shell of the tape printer 1.

The apparatus housing 11 is shaped like a cuboid. The apparatus housing 11 includes a first housing face 111 on the +X side of the apparatus, a second housing face 112 on the −Y side of the apparatus, a third housing face 113 on the −X side of the apparatus, a fourth housing face 114 on the +Y side of the apparatus, a fifth housing face 115 on the +Z side of the apparatus, and a sixth housing face 116 on the −Z side of the apparatus. The first housing face 111 and the third housing face 113 are the largest of the six housing faces. Under normal operating conditions, the tape printer 1 is placed on a desk or the like with the sixth housing face 116 facing downward (in the vertical direction).

The apparatus housing 11 also includes a first printer-side chamfered portion 117 and a second printer-side chamfered portion 118. The first printer-side chamfered portion 117 is provided at the corner of the apparatus housing 11 at which the second housing face 112 and the fifth housing face 115 intersect (more specifically, orthogonally intersect) each other. The second printer-side chamfered portion 118 is provided at the corner of the apparatus housing 11 at which the second housing face 112 and the sixth housing face 116 intersect (more specifically, orthogonally intersect) each other. Incidentally, each of the second housing face 112, the fifth housing face 115, and the sixth housing face 116 intersects (more specifically, orthogonally intersects) the first housing face 111.

The apparatus housing 11 includes the cartridge mounting section 14 and a battery mounting section (not shown).

The cartridge mounting section 14 is provided from the first housing face 111 to the second housing face 112. A tape cartridge TC, which contains a tape strip on which printing is performed, is mounted in the cartridge mounting section 14. The cartridge mounting section 14 includes a first cavity opening portion 141 provided in the first housing face 111 and a second cavity opening portion 142 provided in the second housing face 112 that continues to the first housing face 111. A tape cartridge TC is mounted in the cartridge mounting section 14 from the first cavity opening portion 141. The second cavity opening portion 142 continues to the first cavity opening portion 141. The first cavity opening portion 141 and the second cavity opening portion 142 of the cartridge mounting section 14 are openably covered with the cartridge lid 12.

The battery mounting section is provided from the sixth housing face 116 to the third housing face 113. Batteries for supplying power to the tape printer 1 are mounted in the battery mounting section. The cavity opening portion of the battery mounting section is openably covered with the battery lid 13.

A tape discharge slot 15 is disposed in the second housing face 112 of the apparatus housing 11. A printed portion of a tape strip supplied from the tape cartridge TC that is mounted in the cartridge mounting section 14 is discharged from the tape discharge slot 15.

A wireless connection button 16, an AC (alternating current) adapter socket 17, a USB (universal serial bus) connector 18, and a cable attaching portion 19 are provided in the fourth housing face 114 of the apparatus housing 11. The wireless connection button 16 is operated to establish wireless communication between the tape printer 1 and external devices. An AC adapter plug is inserted into the AC adapter socket 17. A USB cable terminal is inserted into the USB connector 18. An antitheft cable is attached to the cable attaching portion 19.

On the first printer-side chamfered portion 117, a lamp region 117*a* is disposed near the first housing face 111 (+X side of the apparatus), and a power button 117*b* is disposed near the third housing face 113 (−X side of the apparatus). One or a plurality of lamps are provided in the lamp region 117*a*. For example, a lamp is caused to illuminate or blink when an error occurs in the tape printer 1. The power button 117*b* is operated to switch on/off the power of the tape printer 1.

Moreover, the width of the first printer-side chamfered portion 117 is made larger near the first housing face 111 (+X side of the apparatus) than that near the third housing face 113 (−X side of the apparatus). In other words, the first printer-side chamfered portion 117 extends toward the first housing face 111 (+X side of the apparatus) and inclines toward the first housing face 111 interior. Because of this arrangement, a user can view lamps that are disposed in the lamp region 117*a* from the first housing face 111 (+X side of the apparatus) as well as from the second housing face 112 (−Y side of the apparatus) (see FIG. 4).

The cartridge lid 12 is opened/closed by a user when, for example, the user mounts/unmounts a tape cartridge TC on and from the cartridge mounting section 14. The cartridge lid 12 includes a non-translucent lid member 121 and a translucent window member 122.

The lid member 121 is attached to the first housing face 111 such that the lid member 121 is rotatable about the +Y end thereof as the pivot. The lid member 121 is shaped substantially the same as the first cavity opening portion 141 of the cartridge mounting section 14 in such a manner that the lid member 121 openably closes the first cavity opening portion 141 of the cartridge mounting section 14. A lid opening 121*a* is provided in the lid member 121.

The window member 122 includes a first window portion 122*a* and a second window portion 122*b*. The first window portion 122*a* closes the lid opening 121*a*. The window member 122 is fixed to the lid member 121 by installing the first window portion 122*a* in the lid opening 121*a* from the backside of the lid member 121. The second window portion 122*b* protrudes in the −X direction from the −Y end of the first window portion 122*a*. The second window portion 122*b* is shaped substantially the same as the second cavity opening portion 142 in such a manner that the second window portion 122*b* openably closes the second cavity opening portion 142 of the cartridge mounting section 14. A finger hook 122*c* is disposed at a base portion of the second window portion 122*b*. The finger hook 122*c* is for receiving a user's finger when a user opens the cartridge lid 12.

In the state in which the cartridge lid 12 is closed, a user can view the tape cartridge TC mounted on the cartridge mounting section 14 through the first window portion 122*a* from the first housing face 111 (+X side of the apparatus). The user can also view the tape cartridge TC from the second housing face 112 (−Y side of the apparatus) through the second window portion 122*b*.

Next, a printer cover 2 will be described with reference to FIGS. 5 to 11. Note that in FIG. 6 and FIG. 8, the printer cover 2 is filled with solid black in order to make the printer cover 2 and the tape printer 1 more recognizable.

The printer cover 2 is an integrally formed body having elasticity and is mounted on the tape printer 1 such that the printer cover 2 wraps around the tape printer 1. The material of the printer cover 2 is not specifically limited but may be formed, for example, by using silicone rubber.

The printer cover 2 is shaped substantially the same as the apparatus housing 11, in other words, shaped like a cuboid. The printer cover 2 includes a first cover face 21 on the +X side of the apparatus, a second cover face 22 on the −Y side of the apparatus, a third cover face 23 on the −X side of the apparatus, a fourth cover face 24 on the +Y side of the apparatus, a fifth cover face 25 on the +Z side of the apparatus, and a sixth cover face 26 on the −Z side of the apparatus. In the state in which the printer cover 2 is mounted on the tape printer 1, the first cover face 21, the second cover face 22, the third cover face 23, the fourth cover face 24, the fifth cover face 25, and the sixth cover face 26 respectively cover the first housing face 111, the second housing face 112, the third housing face 113, the fourth housing face 114, the fifth housing face 115, and the sixth housing face 116.

The printer cover 2 also includes a first cover-side chamfered portion 27 and a second cover-side chamfered portion 28. The first cover-side chamfered portion 27 is provided at the corner of the printer cover 2 at which the second cover face 22 and the fifth cover face 25 intersect (more specifically, orthogonally intersect) each other. The first cover-side chamfered portion 27 covers the first printer-side chamfered portion 117. The second cover-side chamfered portion 28 is provided at the corner of the printer cover 2 at which the second cover face 22 and the sixth cover face 26 intersect (more specifically, orthogonally intersect) each other. The second cover-side chamfered portion 28 covers the second printer-side chamfered portion 118. Incidentally, each of the second cover face 22, the fifth cover face 25, and the sixth cover face 26 intersects (more specifically, orthogonally intersects) the first cover face 21.

A first lid-exposure opening 211 is provided in the first cover face 21. In the state in which the printer cover 2 is mounted on the tape printer 1, the lid member 121 is exposed through the first lid-exposure opening 211. In addition, a second lid-exposure opening 221 is provided in the second cover face 22 that continues to the first cover face 21. The second lid-exposure opening 221 continues to the first lid-exposure opening 211. In the state in which the printer cover 2 is mounted on the tape printer 1, the second window portion 122*b* and the tape discharge slot 15 are exposed through the second lid-exposure opening 221. The second lid-exposure opening 221 is smaller than the first lid-exposure opening 211.

Accordingly, in the state in which the printer cover 2 is mounted on the tape printer 1, the lid member 121 of the cartridge lid 12 is exposed through the first lid-exposure opening 211, and the second window portion 122*b* of the cartridge lid 12 is exposed through the second lid-exposure opening 221. This enables the cartridge lid 12 to be opened/closed while the printer cover 2 is mounted on the tape printer 1. In other words, a user can open/close the cartridge lid 12 while the printer cover 2 remains mounted on the tape printer 1.

Moreover, in the state in which the printer cover 2 is mounted on the tape printer 1, the first window portion 122*a* of the cartridge lid 12 is exposed through the first lid-exposure opening 211, and the second window portion 122*b* of the cartridge lid 12 is exposed through the second lid-exposure opening 221. Thus, in the state in which the printer cover 2 is mounted on the tape printer 1, the tape cartridge TC mounted in the cartridge mounting section 14 can be viewed through the first window portion 122*a* and the second window portion 122*b*. In other words, a user can view the tape cartridge TC mounted in the cartridge mounting section 14 through the first window portion 122*a* or the second window portion 122*b* while the printer cover 2 remains mounted in the tape printer 1.

Moreover, in the state in which the printer cover 2 is mounted on the tape printer 1, the tape discharge slot 15 is exposed through the second lid-exposure opening 221. This enables a printed tape strip to be discharged from the tape discharge slot 15 while the printer cover 2 is mounted on the tape printer 1. In other words, a user can cause the tape printer 1 to execute printing while the printer cover 2 remains mounted on the tape printer 1.

Figure 9:
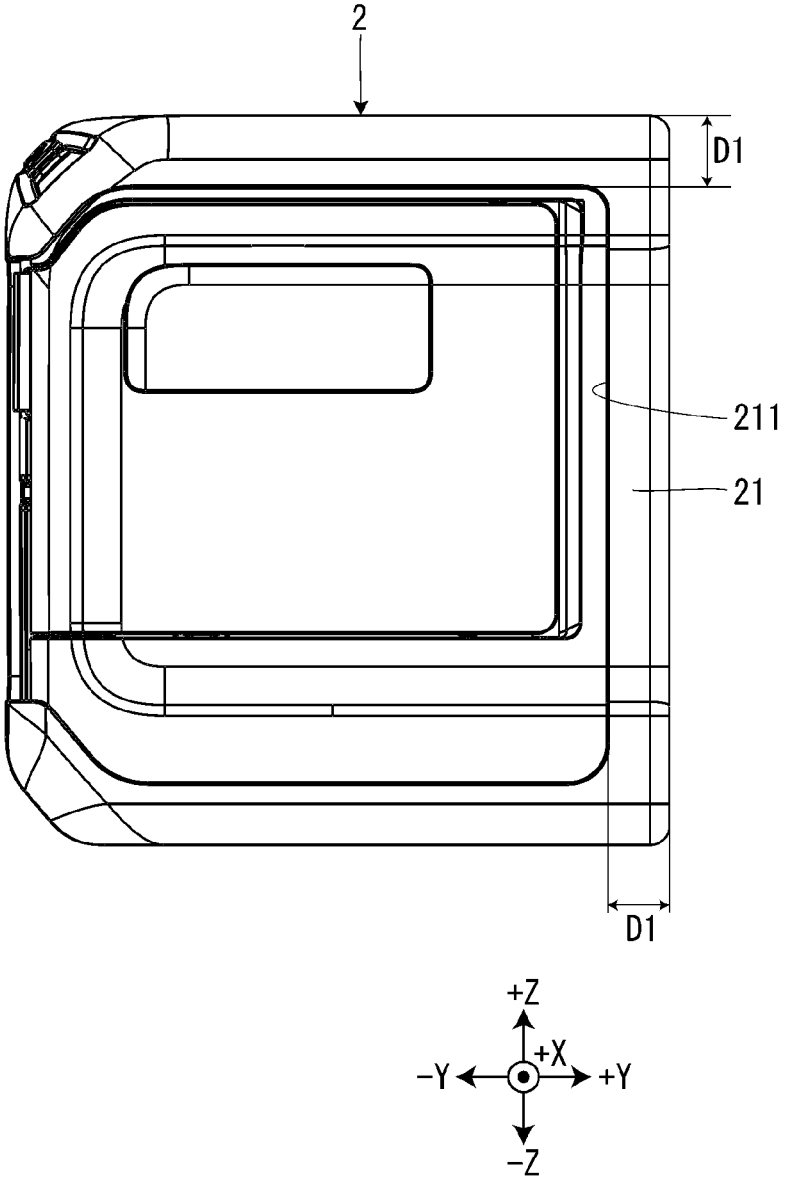
FIG. 9 is a view illustrating a printer cover that is mounted on the tape printer when viewing the first cover face.
Figure 10:
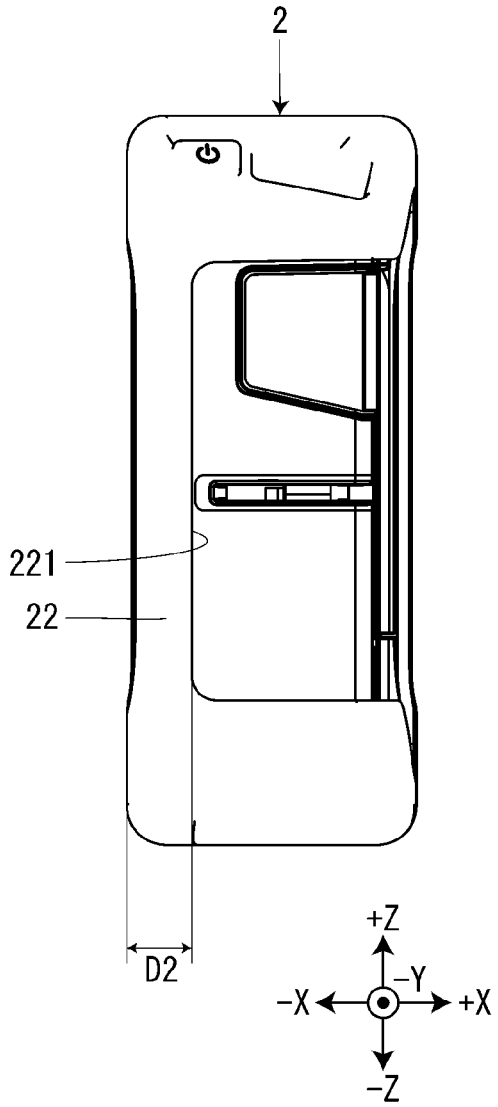
FIG. 10 is a view illustrating a printer cover that is mounted on the tape printer when viewing the second cover face.
Figure 11:
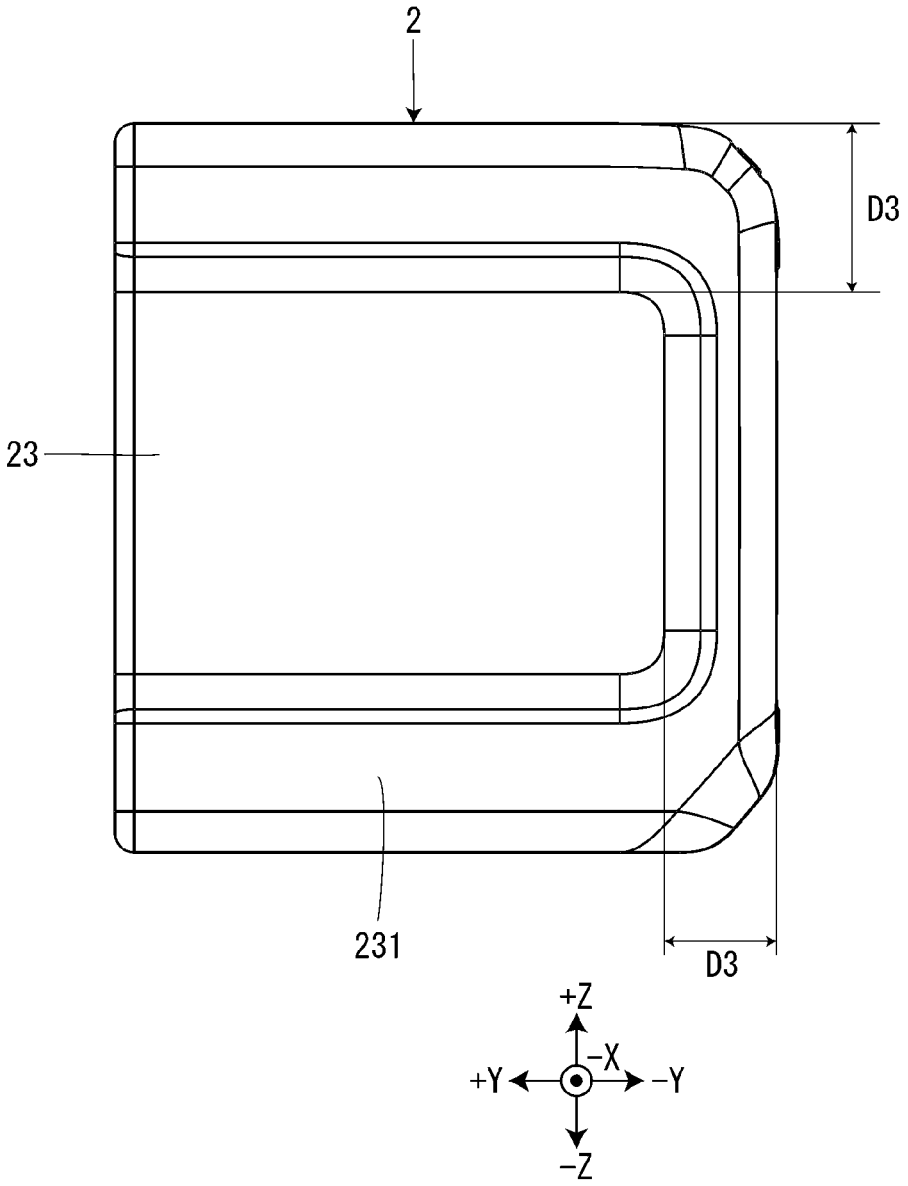
FIG. 11 is a view illustrating a printer cover that is mounted on the tape printer when viewing the third cover face.

It is preferable that in the first cover face 21, the edge width D1 of the first lid-exposure opening 211 be 10 mm or more and 15 mm or less (see FIG. 9). It is also preferable that in the second cover face 22, the edge width D2 of the second lid-exposure opening 221 be 10 mm or more and 15 mm or less (see FIG. 10). If the edge width D1 of the first lid-exposure opening 211 and the edge width D2 of the second lid-exposure opening 221 are 10 mm or more, the edge portions of the tape printer 1 can be protected appropriately. If the edge width D1 of the first lid-exposure opening 211 and the edge width D2 of the second lid-exposure opening 221 are 15 mm or less, the printer cover 2 can be easily mounted/unmounted.

A thick wall portion 231 is provided in the peripheral portion of the third cover face 23. The thick wall portion 231 is shaped like the letter "U" with the +Y side being open. The thick wall portion 231, which is thicker than the center portion of the third cover face 23, is formed as a mound that projects outward. The width D3 of the thick wall portion 231 is larger than any of the edge width D1 of the first lid-exposure opening 211 and the edge width D2 of the second lid-exposure opening 221. For example, the width D3 is 20 mm or more (see FIG. 11).

A button exposure opening 241 is provided in the fourth cover face 24. In the state in which the printer cover 2 is mounted on the tape printer 1, the wireless connection button 16, the AC adapter socket 17, the USB connector 18, and the cable attaching portion 19 are exposed through the button exposure opening 241. This provides access to the wireless connection button 16 and other components in the state in which the printer cover 2 is mounted on the tape printer 1. In other words, while the printer cover 2 remains mounted on the tape printer 1, a user can press the wireless connection button 16, insert an AC adapter plug into the AC adapter socket 17, insert a terminal of a USB cable into the USB connector 18, or attach a cable to the cable attaching portion 19.

A lamp exposure opening 27*a* and a button cover 27*b* are provided in the first cover-side chamfered portion 27.

In the state in which the printer cover 2 is mounted on the tape printer 1, the lamp region 117*a* of the first printer-side chamfered portion 117 is exposed through the lamp exposure opening 27*a*. This enables a user to view lamps disposed in the lamp region 117*a* while the printer cover 2 is mounted on the tape printer 1. In other words, a user can view the lamps while the printer cover 2 remains mounted on the tape printer 1.

The button cover 27*b* covers the power button 117*b* of the first printer-side chamfered portion 117. A symbol representing the power button 117*b* is indicated on the surface of the button cover 27*b*. The thickness of the button cover 27*b* is smaller than that of the peripheral portion of the button cover 27*b* (in other words, the peripheral portion of the first cover-side chamfered portion 27). Put another way, the button cover 27*b* has a depressed outer surface. This can make the position of the power button 117*b* more recognizable and can improve operability of the power button 117*b* in the state in which the printer cover 2 is mounted on the tape printer 1. In other words, a user can find the position of the power button 117*b* easily and can confirm, through the touch of a finger, whether the power button 117*b* has been pressed even when the printer cover 2 is mounted on the tape printer 1.

Moreover, similarly to the first printer-side chamfered portion 117, the width of the first cover-side chamfered portion 27 is made larger near the first cover face 21 (+X side of the cover) than that near the third cover face 23 (−X side of the cover). In other words, the first cover-side chamfered portion 27 extends toward the first cover face 21 (+X side of the cover) and inclines toward the first cover face 21 interior.

When the printer cover 2 formed in such a manner is mounted on the tape printer 1, a user first expands the first lid-exposure opening 211 and the second lid-exposure opening 221. In this state, the user squeezes the tape printer 1 into the printer cover 2 from the first lid-exposure opening 211 and the second lid-exposure opening 221. As described above, the first lid-exposure opening 211 and the second lid-exposure opening 221 are continuously formed, which enables the user to expand the first lid-exposure opening 211 and the second lid-exposure opening 221 easily.

Subsequently, the user adjusts corners of the tape printer 1 (more specifically corners of the apparatus housing 11) to corresponding corners of the printer cover 2. As described above, the first printer-side chamfered portion 117 is provided at the corner of the apparatus housing 11 at which the second housing face 112 intersects the fifth housing face 115, and the first cover-side chamfered portion 27 is provided at the corner of the printer cover 2 at which the second cover face 22 intersects the fifth cover face 25. In other words, the corner portion of the apparatus housing 11 at which the second housing face 112 intersects the fifth housing face 115 and the corner portion of the printer cover 2 at which the second cover face 22 intersects the fifth cover face 25 have larger internal angles compared with a case in which the first printer-side chamfered portion 117 and the first cover-side chamfered portion 27 are not provided. Because of this arrangement, the corner portion of the printer cover 2 at which the second cover face 22 intersects the fifth cover face 25 can easily fit into the corner portion of the apparatus housing 11 at which the second housing face 112 intersects the fifth housing face 115. Similarly, the second printer-side chamfered portion 118 is provided at the corner of the apparatus housing 11 at which the second housing face 112 intersects the sixth housing face 116, and the second cover-side chamfered portion 28 is provided at the corner of the printer cover 2 at which the second cover face 22 intersects the sixth cover face 26. Because of this arrangement, the corner portion of the printer cover 2 at which the second cover face 22 intersects the sixth cover face 26 can easily fit into the corner portion of the apparatus housing 11 at which the second housing face 112 intersects the sixth housing face 116.

When the user releases the printer cover 2 and the tape printer 1 after corners of the tape printer 1 fit into corresponding corners of the printer cover 2, the printer cover 2 is brought into a close contact with the apparatus housing 11 due to the elasticity of the printer cover 2.

On the other hand, when the printer cover 2 is removed from the tape printer 1, the user expands the first lid-exposure opening 211 and the second lid-exposure opening 221. In this state, the tape printer 1 is taken out from the first lid-exposure opening 211 and the second lid-exposure opening 221. As described above, the first printer-side chamfered portion 117 extends toward the first housing face 111 (+X side of the apparatus) and inclines toward the first housing face 111 interior. In addition, the first cover-side chamfered portion 27 extends toward the first cover face 21 (+X side of the cover) and inclines toward the first cover face 21 interior. Thus, the user can pull the end of the first cover-side chamfered portion 27 near the first cover face 21 outward from the first cover face 21 with less effort compared with a case in which the first cover-side chamfered portion 27 does not incline. Consequently, the user can expand the first lid-exposure opening 211 and the second lid-exposure opening 221 easily.

In summary, the printer cover 2 according to the present embodiment is an integrally-formed body having elasticity and is mounted on the tape printer 1. The tape printer 1 includes a plurality of housing faces and the cartridge lid 12. The housing faces include the first housing face 111 on which the first cavity opening portion 141 of the cartridge mounting section 14 is formed and the second housing face 112 on which the second cavity opening portion 142 of the cartridge mounting section 14 is formed. The lid member 121 of the cartridge lid 12 openably closes the first cavity opening portion 141, and the second window portion 122*b* of the cartridge lid 12 openably closes the second cavity opening portion 142. The printer cover 2 includes a plurality of cover faces, the first lid-exposure opening 211, and the second lid-exposure opening 221. The cover faces include the first cover face 21 that covers the first housing face 111 and the second cover face 22 that covers the second housing face 112. The lid member 121 of the cartridge lid 12 is exposed through the first lid-exposure opening 211 that is provided in the first cover face 21. The second window portion 122*b* of the cartridge lid 12 is exposed through the second lid-exposure opening 221 that is provided in the second cover face 22.

This enables the cartridge lid 12 to be opened/closed in the state in which the printer cover 2 is mounted on the tape printer 1. Thus, a user can open/close the cartridge lid 12 while the printer cover 2 remains mounted on the tape printer 1.

Note that the first cavity opening portion 141 and the second cavity opening portion 142 are examples of cavity opening portions. The first housing face 111, the second housing face 112, the third housing face 113, the fourth housing face 114, the fifth housing face 115, and the sixth housing face 116 are examples of housing faces. The first housing face 111 and the second housing face 112 are examples of mounting-side housing faces. The first cover face 21, the second cover face 22, the third cover face 23, the fourth cover face 24, the fifth cover face 25, and the sixth cover face 26 are examples of cover faces. The first cover face 21 and the second cover face 22 are examples of mounting-side cover faces. The first lid-exposure opening 211 and the second lid-exposure opening 221 are examples of lid exposure openings. The lid member 121 is an example of a first lid portion. The second window portion 122*b* is an example of a second lid portion. The first printer-side chamfered portion 117 and the second printer-side chamfered portion 118 are examples of printer-side chamfered portions. The first cover-side chamfered portion 27 and the second cover-side chamfered portion 28 are examples of cover-side chamfered portions. The power button 117*b* is an example of an operation button.

It should be understood that the invention is not limited to the embodiment described above and various modifications can be made without departing from the scope and spirit of the invention. For example, the present embodiment may be modified into the following forms.

The printer cover 2 need not include both of the first lid-exposure opening 211 and the second lid-exposure opening 221. For example, if the tape printer 1 includes only the first cavity opening portion 141 in the cartridge mounting section 14 and the cartridge lid 12 closes only the first cavity opening portion 141, the printer cover 2 can be formed to include only the first lid-exposure opening 211. In this case, it is preferable that the tape discharge slot 15 be not covered with the printer cover 2. For example, an opening through which the tape discharge slot 15 is exposed may be provided in the second cover face 22 such that the opening does not continue to the first lid-exposure opening 211. Alternatively, the tape discharge slot 15 may be provided in the first housing face 111 (more specifically at a position that can be exposed through the first lid-exposure opening 211).

The lid member 121 need not be exposed completely through the first lid-exposure opening 211 but may be covered partially provided that the cartridge lid 12 can be opened/closed without hindrance. The same applies to the second lid-exposure opening 221.

It has been described that the printer cover 2 includes chamfered portions (the first cover-side chamfered portion 27, the second cover-side chamfered portion 28) at the respective corners between the second cover face 22 and the fifth cover face 25 and between the second cover face 22 and the sixth cover face 26. However, a chamfered portion need not be provided at each one of the corners, but may be provided at either one of the corners. Alternatively, the printer cover 2 may include a chamfered portion, for example, at the corner between the fourth cover face 24 and the fifth cover face 25 or at the corner between the fourth cover face 24 and the sixth cover face 26. The same applies to corners of the tape printer 1.

In the printer cover 2, the first cover-side chamfered portion 27 extending toward the first cover face 21 need not incline toward the first cover face 21 interior. Alternatively, the second cover-side chamfered portion 28 extending to the first cover face 21 may incline toward the first cover face 21 interior. The same applies to the first printer-side chamfered portion 117 or the second printer-side chamfered portion 118 of the tape printer 1.

The button cover 27*b* may be thicker than the peripheral portion of the button cover 27*b*. In other words, the button cover 27*b* may have a convex outer surface. If an operation button, other than the power button 117*b* (for example, a stop button for stopping printing), is covered with the printer cover 2, a portion to cover the operation button (a button cover face) may be formed thinner or thicker compared with the peripheral portion.

In addition to the first lid-exposure opening 211, the second lid-exposure opening 221, the button exposure opening 241, and the lamp exposure opening 27*a*, the printer cover 2 may include an opening through which a certain portion of the tape printer 1 is exposed provided that the printer cover 2 can be mounted on the tape printer 1 appropriately. For example, the printer cover 2 may include, in place of the button cover 27*b*, an opening through which the power button 117*b* is exposed. Alternatively, the printer cover 2 may include an opening through which the battery lid 13 is exposed.

This application claims priority under 35 U.S.C. § 119 to Japanese Patent Application No. 2017-055810, filed Mar. 22, 2017. The entire disclosure of Japanese Patent Application No. 2017-055810 is hereby incorporated herein by reference.

What is claimed is:

1. A printer cover that is configured to be mounted on a tape printer that includes: (i) a plurality of housing faces that have mounting-side housing faces in which corresponding cavity opening portions of a cartridge mounting section into which a tape cartridge is mounted are formed, and (ii) a cartridge lid that openably closes the cavity opening portions, the printer cover comprising:

an integrally-formed elastic body that is formed as one-piece, the integrally-formed elastic body including:

a plurality of cover faces comprising mounting-side cover faces that are configured to cover the corresponding mounting-side housing faces of the tape printer, and a plurality of lid exposure openings that are provided in the corresponding mounting-side cover faces and through which the cartridge lid is configured to be exposed, the plurality of lid exposure openings including:

a first lid-exposure opening that is provided in a first mounting-side cover face that is disposed on a first surface of the tape printer and through which the first lid portion is configured to be exposed, and a second lid-exposure opening that is provided in a second lid portion disposed on a second surface of the tape printer that is different from the first surface, the second lid-exposure portion continuously extending from the first lid-exposure opening and through which the second lid portion is configured to be exposed.

2. The printer cover according to claim 1, wherein in the tape printer, the cartridge lid comprises a first lid portion and a second lid portion that extends from the first lid portion, the first lid portion is configured to close a first cavity opening portion of the cavity opening portions that is formed in a first mounting-side housing face of the mounting-side housing faces, and the second lid portion is formed in a second mounting-side housing face of the mounting-side housing faces that extends from the first mounting-side housing face and is configured to close a second cavity opening portion of the cavity opening portions that extends from the first cavity opening portion, and in the printer cover, the mounting-side cover faces comprise a first mounting-side cover face that is configured to cover the first mounting-side housing face and a second mounting-side cover face that extends from the first mounting-side cover face and is configured to cover the second mounting-side housing face.

3. The printer cover according to claim 1, further comprising a cover-side chamfered portion, wherein the tape printer further comprises a printer-side chamfered portion provided at a corner portion of the tape printer at which two of the housing faces that intersect the mounting-side housing face intersect each other, the cover-side chamfered portion is provided at a corner portion of the printer cover at which two of the cover faces that intersect the mounting-side cover face intersect each other, and the cover-side chamfered portion is configured to cover the printer-side chamfered portion.

4. The printer cover according to claim 3, wherein in the tape printer, the printer-side chamfered portion extends toward the mounting-side housing face and inclines toward the mounting-side housing face interior, and in the printer cover, the cover-side chamfered portion extends toward the mounting-side cover face and inclines toward the mounting-side cover face interior.

5. The printer cover according to claim 1, further comprising a button cover, wherein the tape printer has an operation button, and the button cover is configured to cover the operation button and has a thickness different from that of a peripheral portion of the button cover.

6. The printer cover according to claim 1, wherein, in the mounting-side cover face, a peripheral portion surrounding the lid exposure opening has an edge width of 10 mm or more and 15 mm or less.

7. The printer cover according to claim 1, wherein the printer cover is mounted on the tape printer such that the printer cover extends continuously around and wraps around a perimeter of the tape printer.

8. The printer cover according to claim 1, wherein:

the tape printer further comprises a battery lid which openably covers a battery mounting section provided at a bottom side of the tape printer, and the printer cover covers the battery lid such that the battery lid is not exposed.

9. The printer cover according to claim 1, wherein the elastic body is mountable onto and removable from the tape printer.

* * * * *